US005544695A

United States Patent [19]

Harasym

[11] Patent Number: 5,544,695

[45] Date of Patent: Aug. 13, 1996

[54] ANTIVORTEXING NOZZLE SYSTEM FOR POURING MOLTEN METAL

[76] Inventor: Michael Harasym, 184 Hunt Valley Cir., Berwyn, Pa. 19312

[21] Appl. No.: 162,749

[22] Filed: Dec. 6, 1993

Related U.S. Application Data

[63] Continuation-in-part of Ser. No. 69,896, Jun. 1, 1993, abandoned.

[51] Int. Cl.[6] ..... B22D 41/16; B22D 41/50

[52] U.S. Cl. ..... 164/437; 164/337; 222/591

[58] Field of Search ..... 164/437, 337; 222/591, 594, 596, 597, 602, 606, 607

[56] References Cited

U.S. PATENT DOCUMENTS

| | | | |
|---|---|---|---|
| 1,321,300 | 11/1919 | Gathmann | 222/606 |
| 2,098,937 | 11/1937 | Brinkmann | 222/591 |
| 3,596,804 | 8/1971 | Barrow et al. | 222/146 |
| 4,785,979 | 11/1988 | Svoboda et al. | 222/591 |
| 5,004,130 | 4/1991 | Vaterlaus | 164/437 |
| 5,171,513 | 12/1992 | Vassilicos | 226/230 |
| 5,203,909 | 8/1993 | Petrushka et al, | 75/375 |
| 5,361,825 | 11/1994 | Lax et al. | 164/437 |

FOREIGN PATENT DOCUMENTS

| | | | |
|---|---|---|---|
| 1004078 | 9/1992 | Belgium . | |
| 122904 | 10/1984 | European Pat. Off. | 164/437 |
| 1063860 | 5/1954 | France . | |
| 63-40668 | 2/1988 | Japan . | |
| 467181 | 6/1937 | United Kingdom | 222/591 |

OTHER PUBLICATIONS

Patent Abstracts of Japan, vol. 12, No. 294 (M–739((3141, 11 Aug. 1988 & JP 63 072 475 (Nippon Kokan KK) 2 Apr. 1988.

Patent Abstracts of Japan, vol. 13, No. 118 (M–806) (3466) 23 Mar. 1989 & JP 63 295 056 (NKK Corp) 1 Dec. 1988.

*Primary Examiner*—Kuang Y. Lin
*Attorney, Agent, or Firm*—Seidel, Gonda, Lavorgna & Monaco

[57] ABSTRACT

A system and a metering assembly are both disclosed, and both relate to reducing the vortexing which can occur during the outflow of molten metal from a holding reservoir to a mold during casting operations. The system includes a first molten metal holding and pouring box with first predetermined dimensions, a second molten metal holding and pouring box with second predetermined dimensions which are less than said first predetermined dimensions and which is positioned relative to said first molten metal holding and pouring box to receive a flow of molten metal therefrom, a first flow control device for controlling the outflow of molten metal located at the bottom region of the first molten metal holding and pouring box, an antivortexing insert located in an inlet portion of said first flow control device for controlling the outflow of molten metal and in direct contact with the molten metal in said holding and pouring box. The antivortexing insert has at least one opening and at least one vane for interacting with the molten metal as it flows into the inlet portion of the first flow control device to reduce vortexing. In its broadest aspect, the present invention is directed to antivortexing insert for a metal pouring vessel including an outlet orifice having a central opening therein for the passage of molten metal therethrough. The antivortexing insert comprises at least one vane extending across the central opening for interacting with molten metal flowing therethrough. The antivortexing insert is located at an inlet region of the central opening.

2 Claims, 10 Drawing Sheets

ANTIVORTEXING NOZZLE SYSTEM FOR POURING MOLTEN METAL

This is a continuation-in-part of application Ser. No. 08/069,896, filed Jun. 1, 1993.

Field of the Invention

The present invention relates to a system used in pouring molten metal and, more particularly, to a system that reduces slag vortexing which can occur during the outflow of molten metal from a tundish or a ladle using a slide gate valve or stopper rod for flow control. The reduction of slag vortexing advantageously results in a higher percentage of metal that is substantially free of slag.

BACKGROUND OF THE INVENTION

Molten metal is often dispensed from a bottom discharge pouring and holding reservoir, sometimes referred to as either a tundish or simply a box, into a mold. The tundish is usually kept supplied with molten metal from a ladle. The purity of the metal being discharged from the tundish is important to successfully cast clean metal into the mold. More particularly, the poured metal should be free of slag that forms on the surface of molten metal and also free of bubbles that are sometimes created and entrained in the metal during the pouring process. If the output flow of molten metal from the ladle entrains any slag or any other unwanted inclusion, the quality of the cast metal is degraded. A major contributor to this degradation is the occurrence of vortexing, in the form of whirlpools, created during the pouring operation as a result of Coriolis forces on the flowing metal.

If slag is drawn by a vortex into the stream of molten metal being poured into a tundish or pouring box, it can easily become trapped in the end product. Further, if the stream of molten metal being poured into the mold is spiraling when it exits the bottom nozzle of the reservoir, the stream may become hollow and enlarged so as to expose much of its lateral surface to the atmosphere. If this exposure occurs, the metal may be reoxidized which, in turn, results in a significant loss of quality in the cast product. Products of reoxidation sometimes get trapped in the solidified cast metal and are generally referred to as dirt.

The danger of slag contamination is almost always present because, as metal is melted, a slag is formed on the surface of the molten metal. However, so long as the slag remains on the top surface, it does not present a problem for successful casting. Unfortunately, and typically, when pouring a batch of steel, slag begins to be vortexed into the output flow of the molten metal from the ladle into the tundish and will undesirably find its way into the mold. The presence, or even the danger of such slag being present in the tundish, commonly causes the pouring process to be terminated. For these situations, as much as two to four percent of the metal may still be left in a ladle, and this amount is treated as scrap to be recycled by being remelted. Remelting of this metal results in an additional, undesired cost. It is thus desired to reduce the vortexing of slag from the ladle into the tundish, especially to reduce the need to remelt these large quantities of metal, so as to decrease costs.

The drawbacks of vortexing are present in both continuous casting and ingot pouring operations. In continuous casting, the molten metal continuously flows out of the orifice of a nozzle and onto a mold to form a continuous shape, such as a steel billet, bloom, slab or strip. In non-continuous casting, the flow of molten metal is stopped after an ingot mold is filled, and then re-started when a new ingot mold is in place.

For continuous casting, it is known that undesired vortexing and spiraling may be reduced by the placement of flutes in the orifice of the nozzle (metering nozzle), located in the bottom portion of the tundish, that feeds the molten metal to the mold. Antivortexing devices are also used with ladles which supply the tundish or ingot mold at the outflow or collector nozzle. Antivortexing devices in the collector nozzle help prevent spiraling of the metal stream leaving the nozzle, but have little effect in preventing vortexing in the ladle itself. It is therefore desired to provide additional antivortexing means upstream from the collector nozzle so as to further reduce the drawbacks caused by vortexing in the ladle.

For ingot casting, it is known to use nozzles having a central opening in which are disposed flutes to improve the quality of the stream flowing out of the nozzle so as to eliminate the vortexing and spiraling effects previously discussed. The quantity and rate of the flow out of the nozzle is controlled by a metering device, such as a stopper rod or slide gate.

Internal flutes have also been used with nozzles having a circular, triangular, or square central bore. Typically, after a heat is poured, the nozzle is rinsed with oxygen to free it of any unwanted residue. Unfortunately, casting and rinsing contributes to the deterioration of the flutes and limits the operational life of the flutes associated with the nozzles to about three to four heats. Normally, nozzles without fluted arrangements handle between eight to twelve heats before their replacement is necessary. The removal of a fluted inner nozzle from a metering assembly after every three or four heats is impractical and very time-consuming, especially when compared to a non-fluted nozzle that does not require replacement until eight to twelve heats have been poured. It is therefore desired to provide fluted nozzles within metering assemblies which are easy to replace, and at the same time still reduce undesired vortexing.

Casting equipment already in use in existing pouring operations suffers from the drawbacks of vortexing and spiraling. The replacement of existing equipment to correct for undesired vortexing and spiraling would involve a considerable expense and would also consume extensive time.

Accordingly, it is one object of the present invention to provide means easily placed into existing pouring equipment which reduces disadvantageous vortexing and spiraling so as to advantageously and conveniently yield higher quality cast metal.

It is a further object of the present invention to provide a pouring ladle for continuous casting equipment upstream from the tundish which has a fluted nozzle feeding the tundish so as to further inhibit any vortexing or spiraling that would otherwise add impurities or bubbles into molten metal or would otherwise allow for reoxidation of the poured metal, all of which contribute to degrading the quality of the end product being cast.

It is another object of the present invention to provide an antivortexing device that is suitable for a tundish so as to inhibit any vortexing or spiralling that would add impurities or bubbles into a molten metal mold or would otherwise allow for reoxidation of the poured metal.

It is another object of the present invention to provide a nozzle assembly having a fluted portion that not only reduces vortexing and spiraling conditions but also allows for the convenient replacement of the fluted portion.

Other objects and advantages of the present invention will become apparent to those skilled in the art with reference to the attached drawings and description of the invention which hereinafter follows.

SUMMARY OF THE INVENTION

In its broadest aspect, the present invention is directed to antivortexing means for a metal pouring vessel including an outlet orifice having a central opening therein for the passage of molten metal therethrough. The antivortexing means comprises at least one vane extending across the central opening for interacting with molten metal flowing therethrough. The antivortexing means is located at an inlet region of the central opening.

In another aspect, the invention is directed to the combination of a slide gate valve and an antivortexing means. The slide gate valve has an inlet, an outlet, an opening extending between the inlet and the outlet and defining a passage for the flow of molten metal therethrough, and a slide mechanism for selectably closing at least a portion of the opening. The antivortexing means is located in the opening adjacent the inlet and comprises at least one vane extending across the opening for interacting with molten metal flowing therethrough.

In another aspect, the invention is directed to a stopper rod including flutes in combination with an antivortexing means for a metal pouring vessel including an outlet orifice having at least one opening therein for the passage of molten metal therethrough. The stopper rod is configured for selectably closing the opening in the outlet orifice.

In a further embodiment, the invention is directed to a molten metal pouring system comprising:

(1) a first molten metal holding and pouring box with first predetermined dimensions;

(2) a second molten metal holding and pouring box with second predetermined dimensions which are less than said first predetermined dimensions and which is positioned relative to said first molten metal holding and pouring box to receive a flow of molten metal therefrom;

(3) a first means for controlling the outflow of molten metal located at the bottom region of the first molten metal holding and pouring box;

(4) antivortexing means located in an inlet portion of said first means for controlling the outflow of molten metal and in direct contact with the molten metal in said holding and pouring box, said antivortexing means having a central opening and at least one vane for interacting with the molten metal as it flows into the central opening to reduce vortexing; and (5) a second means for controlling the outflow of molten metal and located at the bottom region of the said second molten metal holding and pouring box, said second means controlling the outflow of molten metal to casting molds.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 3(*a–b*) illustrates a modified subentry shroud adapted to engage a stopper rod to selectably close at least a portion of an outlet orifice.

DESCRIPTION OF THE INVENTION

Figure 1:
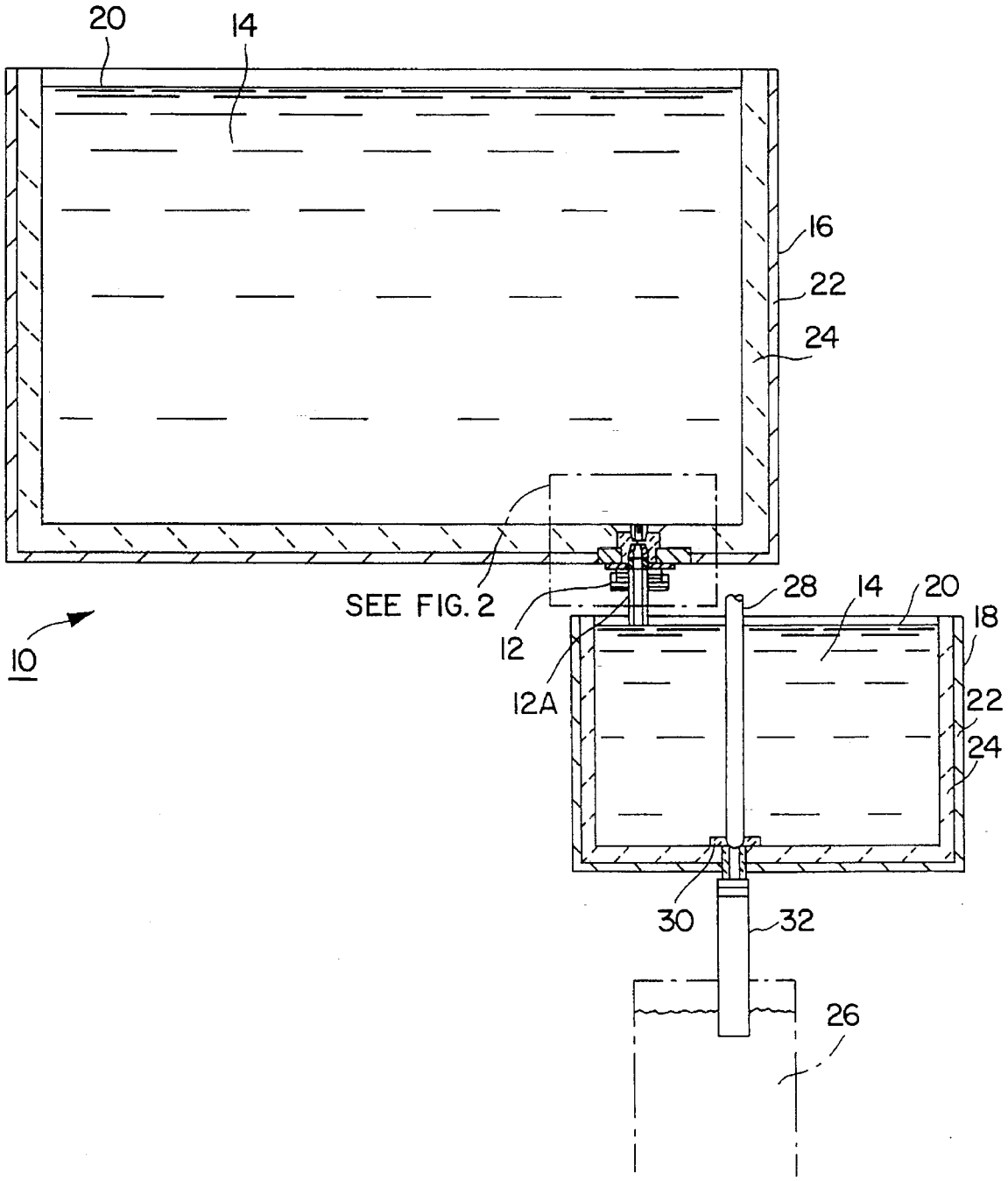
FIG. 1 illustrates the interrelationship of the primary elements of the molten metal pouring system of the present invention.
Figure 2:
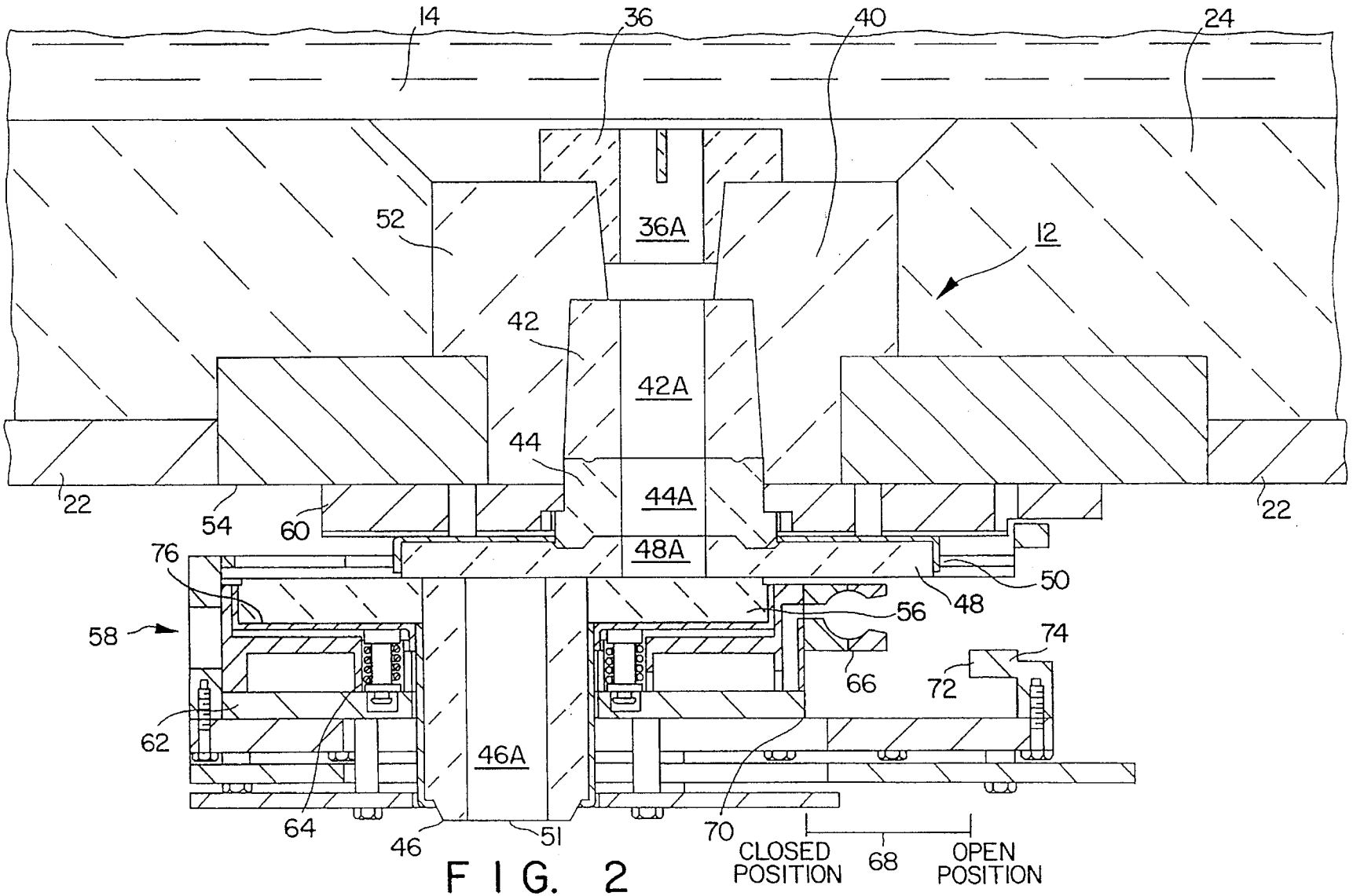
FIG. 2 is an illustration of the metering nozzle assembly of the present invention.

Referring now to the drawings, wherein like numerals indicate like elements, there is shown in FIG. 1 a system 10 for use in continuous casting and in FIG. 2 a metering assembly 12. The system 10 and the metering assembly 12 both pertain to the continuous casting of molten metal, and both the system 10 and the metering assembly 12 reduce vortexing and spiraling which normally occur when pouring molten meal into molds and tundishes and which sometimes cause slag to be entrained into the meal being poured, or bubbles or voids to be created in the cast meal. While the antivortexing insert described herein is equally effective in a tundish as in a ladle, the following description will be directed primarily to insallation in a ladle for clarity. The methods for using the antivortexing insert in a tundish and a ladle are the same.

The system 10 pertains primarily to controlling the outflow of the molten meal 14 from each of the metering assemblies 12 so as to provide a non-turbulent, laminar type flow 12A. The system 10 comprises a first molten meal holding and pouring box in the form of pouring ladle 16 and a second molten meal holding and pouring box in the form of tundish 18, both of which contain molten metal 14. As is typical, molten metal 14 has a layer of slag 20 on its upper surface. Each of the first and second holding and pouring boxes 16 and 18 comprise a shell 22, preferably made of high temperature steel, and a lining 24, preferably of a refractory material. Each of the boxes 16 and 18 have predetermined dimensions, with the box 16 having a volume which is substantially greater than that of the box 18.

In molten metal pouring systems, the larger box 16 is generally referred to as a ladle and the smaller box 18 is generally referred to as a tundish, as mentioned above. (The terms ladle and first molten metal holding and pouring box, as well as the terms tundish and molten meal second holding and pouring box, are used herein interchangeably.) The tundish 18 is positioned downstream from the ladle 16 and receives the outflow of molten metal being poured from the ladle 16. The ladle 16 and tundish 18 provide molten metal 14 to be used for the casting of billets, blooms, slabs or strips 26.

The flow rate (Q) of molten metal 14 being poured from either molten metal holding and pouring box 16 or 18 is a function of the height of the molten metal within the respective box (the "ferrostatic head"), the size of the bore or orifice of the nozzle from which the molten metal flows, and the operation of a flow control mechanism, such as a slide gate valve 12 or a stopper rod assembly 28. In addition, since flow is a function of nozzle opening dimensions, the outflow may be left uncontrolled by either a slide gate valve or a stopper rod, and instead controlled by a metering nozzle 30. It should be mentioned here that a stopper rod 28 is typically used only with the tundish 18, and not with ladle 16.

The tundish 18 is positioned directly over the mold or molds to be cast, and may include a plurality of nozzles each located in the bottom region of the tundish 18, and each supplying molten metal to a respective mold, so that a plurality of shapes, such as steel billets, blooms, slabs or strips, are cast. The stopper rod mechanism 28 may be used to control the quantity of the flow of molten metal out of tundish 18, and such a mechanism is well-known in the art.

As further shown in FIG. 1, the second molten metal holding and pouring box 18 is positioned over a mold 26. The outflow of molten metal from the second box 18 is directed into a subentry shroud or subentry nozzle 32 of mold 26. This allows the flow of molten metal to be directed, by gravity, into mold 26. The casting of the mold 26 is accomplished in an integrated manner with the control of the output flow provided by, for example, a stopper rod mechanism 28, a slide gate valve or a metering nozzle, in known manner.

The metering assembly will be further described with reference to FIG. 2. The metering assembly 12 controls the outflow of the molten metal from the box 16. The metering assembly 12 comprises an insert 36 and a well block 52. Well block 52 comprises two nozzle elements, an upper well nozzle 42 and a lower well nozzle 44. Metering assembly 12 further comprises a stationary plate 48 held in place by a stationary plate retainer 50 (also known as a base plate or mounting plate), and a mobile plate 56 and a collector nozzle 46. The insert 36, the nozzle elements 42, 44, 46, and stationary plate 48 are each preferably composed of a refractory material. The insert 36 defines at least one opening 36A. Nozzle elements 42, 44, 46 and stationary plate 48, respectively, have central openings 42A, 44A, 46A and 48A. The insert 36, and the upper well nozzle 42 and the lower well nozzle 44 are situated, at least partially, within the bottom refractory lining 24 of the bottom wall of, preferably, box 16 is supported thereat by means of a pocket block or well block 52 comprising a refractory material. Adjacent the well block 52 is a leveling plate 54.

The stationary plate 48 is positioned between the lower well nozzle 44 and the collector nozzle 46. A movable slide plate 56 supports and is attached to the upper region of the collector nozzle 46. The slide plate 56 cooperates with the stationary plate 48 and forms a typical slide gate control device. The slide gate control device further comprises a slide gate mechanism 58 that is mounted to its associated box 16 by means of a mounting plate 60.

The slide gate mechanism 58 has a carriage 62 which includes a spring mounted mechanism 64 that assists in keeping slide plate 56 in close contact with stationary plate 48. The carriage 62 is laterally moved by an external device (not shown) attached to arm 66. Carriage 62 is moved by an amount or distance 68 shown in FIG. 2. The extremes of movement, related to distance 68, are identified in FIG. 2 as the CLOSED and OPEN positions, as will be well known to those skilled in this art. Normally when the gate is in the OPEN position, without the benefits of the present invention or without some type of insert, vortexing and spiraling would be present in the outflow of molten metal from the metering assembly 12.

Figure 11A:
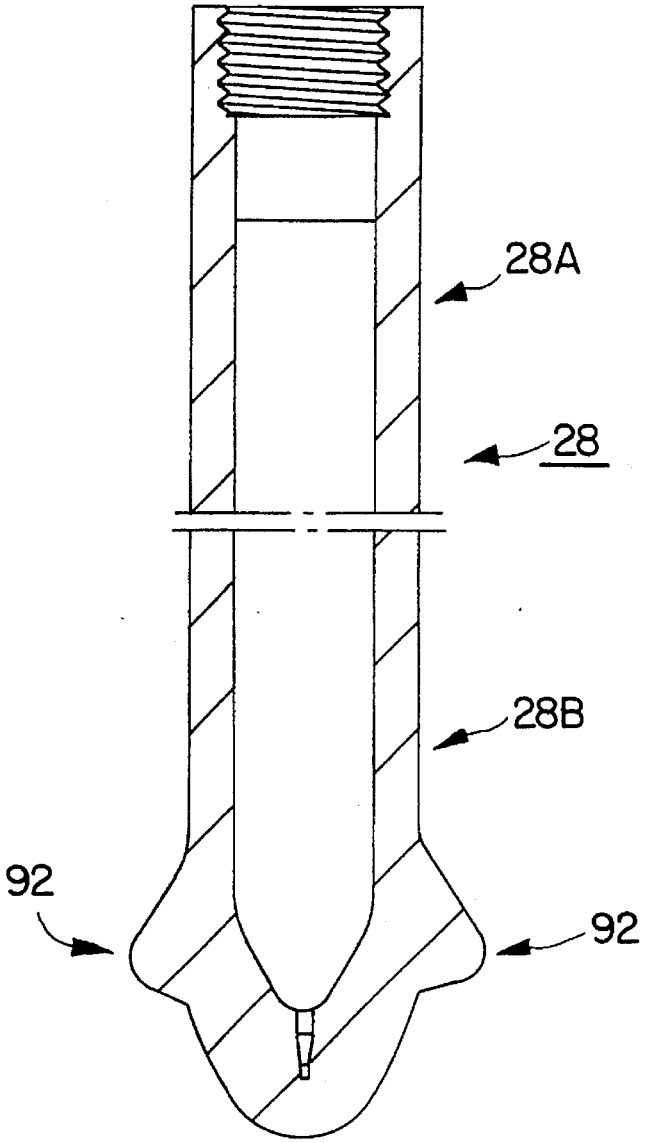
FIG. 11(*a–b*) is a modified stoper rod including flutes near the base of the stopper rod.
Figure 11B:
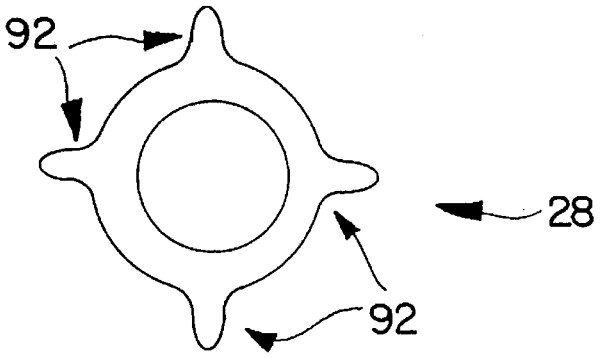
Figure 12A:
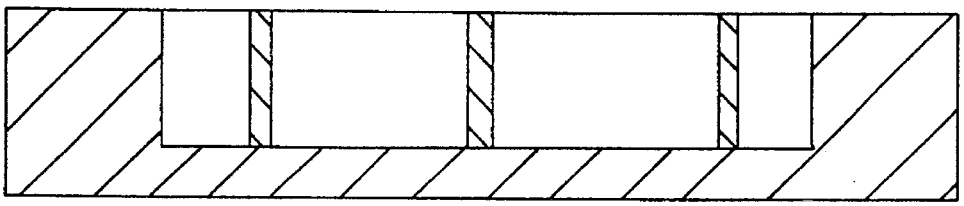
FIG. 12(*a–b*) illustrates a vortex suppressing insert that incorporates flutes to be used in combination with a stopper rod which reduce vortexing of the outflow of molten metal from the metering assembly.
Figure 12B:
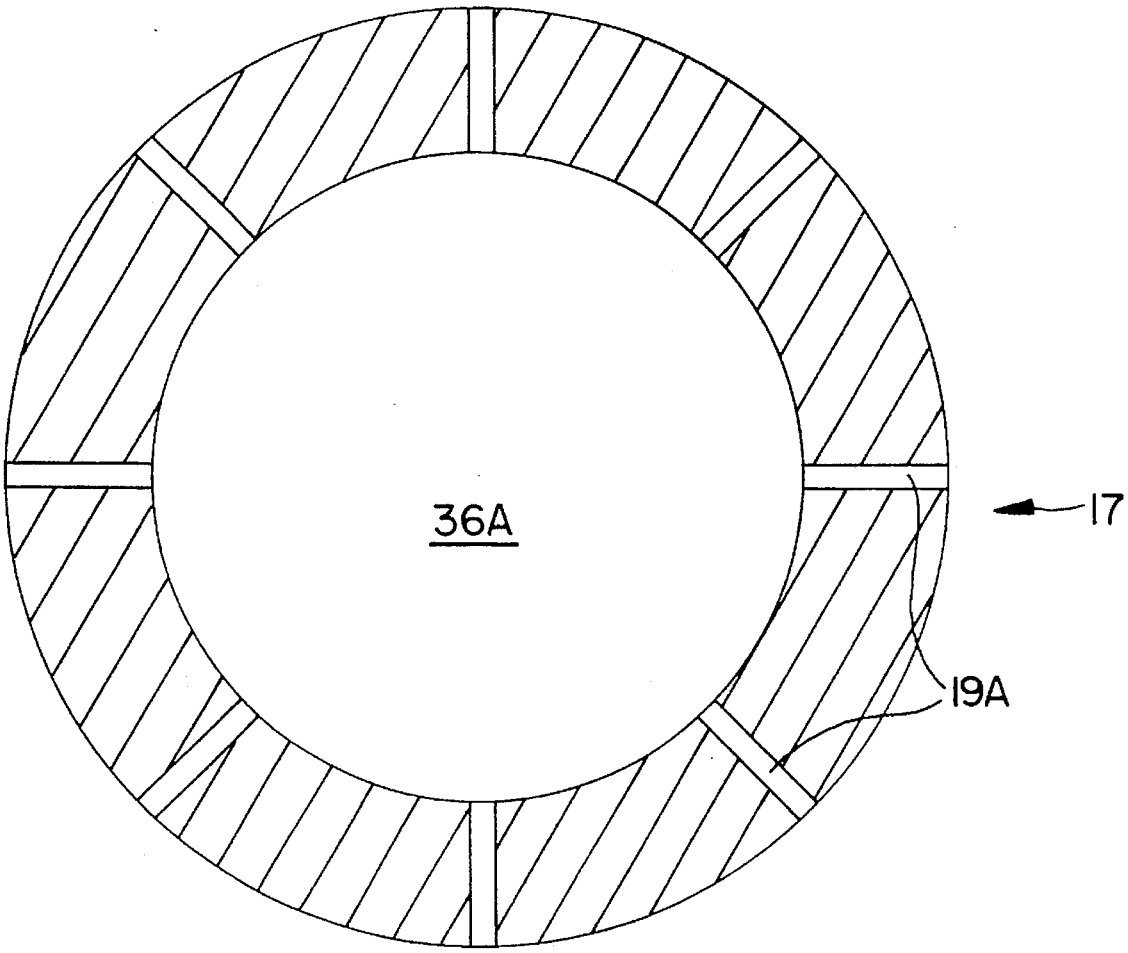

An alternative metering assembly comprises a stopper rod assembly 28, an insert 36 and a modified subentry shroud 32. As shown in FIG. 11, stopper rod 28 further comprises an upper section 28A and a lower base or tip section 28B. Base 28B further comprises flutes or vanes 92 arranged around its circumference. Insert 36 defines at least one opening 36A. The modified stopper rod 28 is constructed of conventional material known to those skilled in the art. The stopper rod 28 must be capable of working in a molten metal environment without any degradation of its structural integrity. Stopper rod 28 is affixed to a power source capable of lifting stopper rod 28 vertically to permit molten metal to flow through opening 36A and into subentry shroud 32.

A metering assembly not having the benefits of the present invention may be visualized from FIG. 2 by removing insert 36 from the metering assembly and considering the freed-up space as being the throat of the well block 52. After the removal of insert section 36, the metering assembly will suffer from the drawbacks of vortexing and spiraling. Spiral could be reduced by the use of a collector-nozzle 46 which includes flutes arranged within its central bore, such as a six-sided symmetrical arrangement of half-circles located about the circumference of the central bore. Such solutions are being used successfully as a means for reducing stream spiraling, but not vortexing. Flutes have also been previously tried in the upper and lower well nozzles, but are not practical. Unfortunately, and as described in the "Background" section, the anticipated life of the flutes in the well nozzles or inner nozzles is somewhat limited and their replacement is relatively expensive but, more importantly, they are relatively difficult to replace because they must be first removed from the confines of the well block 52. The present invention eliminates these difficulties by permitting the insert 36 to be simply dropped into place in the throat of well block 52 and by using a standard collector nozzle (such as nozzle 46 of FIG. 2) having a central bore that does not include any flutes. When the insert 36 (having an anticipated life similar to that of the prior art fluted collector nozzle) needs to be replaced, the worn out insert 36 is merely lifted out of the throat of the well block 52 and its replacement is dropped into place in the same throat. Unlike prior art devices, the insert 36 allows the metering nozzle assembly to be restored to its operational readiness with only minor delay.

Figure 3:
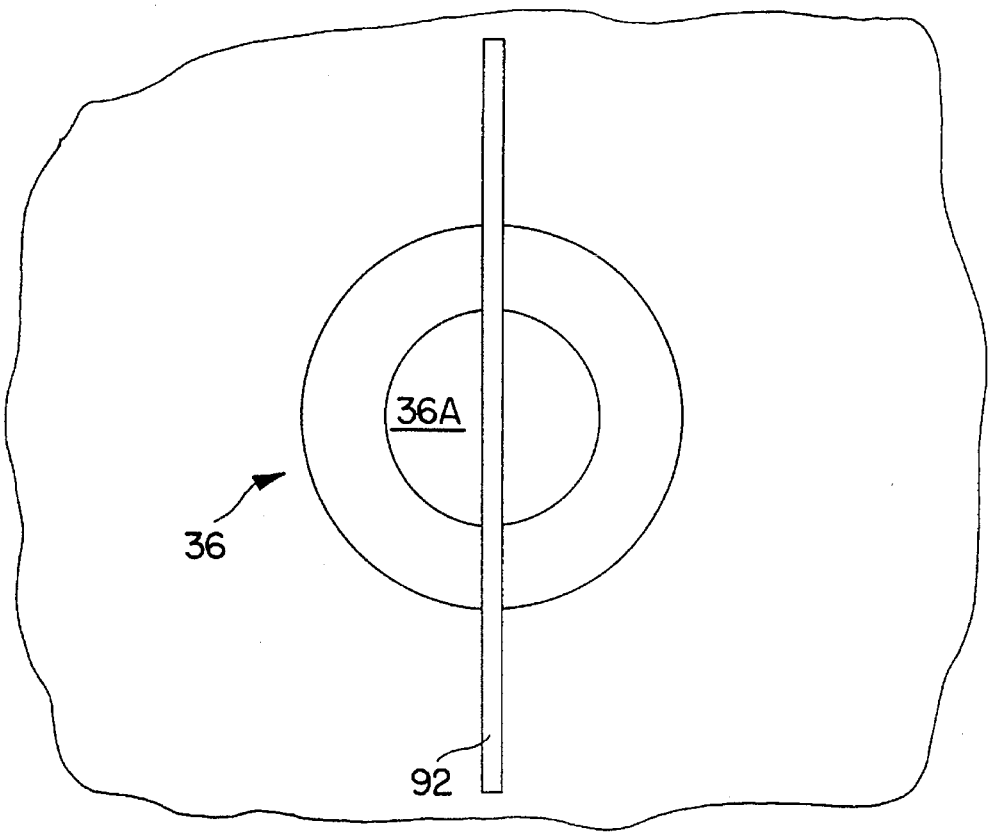
FIGS. 3, 4 and 4*a* illustrate one embodiment of the insert which reduces vortexing of the outflow of molten metal from the metering assembly.

The insert 36 is further described with reference to FIGS. 3, 4, 4*a*, 7 and 7*a*. The insert 36 shown in FIG. 3 is shown in combination with a housing comprising an outer wall having a base 82 and upper edge 84. The insert 36 shown in FIGS. 4 and 7 can be simply dropped into the throat of the well block 52 and may be operatively located to be in direct contact with the molten metal above the horizontal plane of well block 52. The insert 36 shown in FIGS. 4 and 7 includes central opening 36A which runs through the insert 36. Opening 36A is illustrated as round, but could be square, triangular or have any other cross-sectional shape. Insert 36 has one or more vanes or flutes 92 which extend into opening 36A and interact with the flow of molten metal before it reaches the central opening 36A. The interaction of the flutes with the flowing molten metal breaks up the swirling motion and reduces vortexing. If the insert 36 is combined with the housing, the insert 36 is preferably tapered outward as its outer wall extends from its base 82 to its upper edge 84. The inner wall of the insert 36 has a downwardly curved sloped portion 86 that starts at a location 88 near the upper edge 84 of the insert 36, and tapers downward into the central opening 36A. The insert 36 also comprises a flat surface 90 so that insert 36 lies flush with well block 52. However, the tops of the vanes 92 could extend above the top of edge 84, if desired. The insert 36 further comprises a flute 92 that extends vertically throughout the first section of insert 36.

Figure 4:
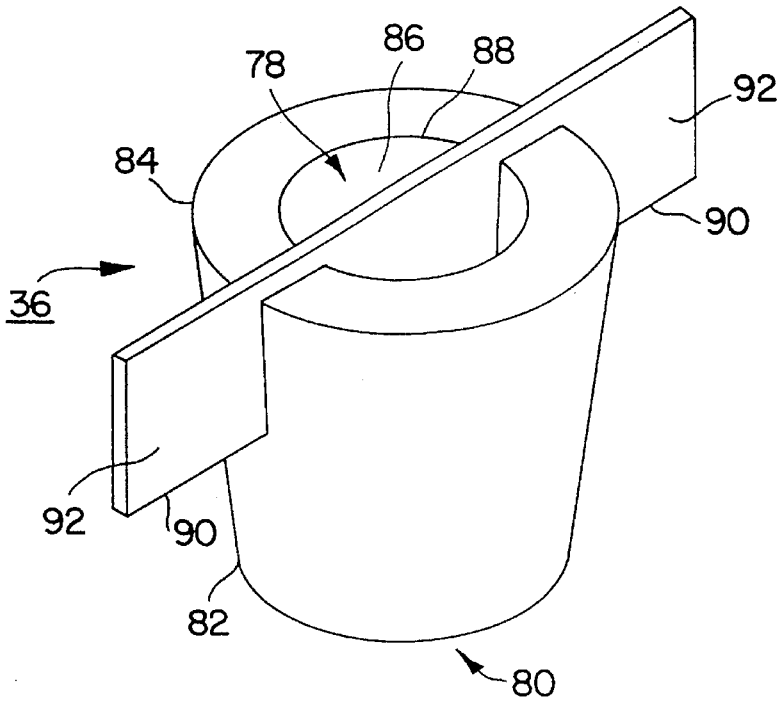
Figure 4A:
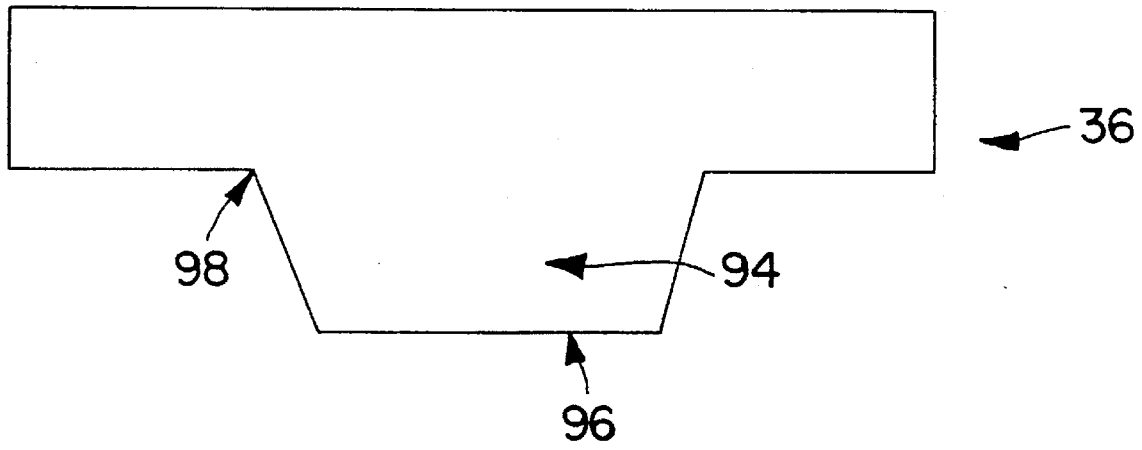

As seen in FIG. 4*a*, insert 36 can be provided without a housing. Insert 36 without a housing includes a lower section 94 configured to engage the inner wall of well block 52. Lower section 94 of insert 36 is preferably tapered outward from a bottom edge 96 to the mid-section 98. Midsection 98 of insert 36 lies flush with well block 52. Insert 36 illustrated in FIG. 4*a* may preferably be configured with two or four vanes 92. More then four vanes 92 may be used but with diminishing improvements per additional vane in relation to spiraling or vortexing.

As seen in FIG. 4, the flute 92 interfers with the spiraling direction of the flow of the molten metal before it enters opening 36A. The flute 92 acts as an antivortexing means to reduce and effectively eliminate any vortexing, i.e., whirling or circular motion of the molten metal, which would otherwise create a force to draw or entrain the slag, located on the surface of the molten metal, toward and into the metal stream.

The flute 92 prevents turbulent flow from occurring and provides a non-turbulent, laminar type flow of molten metal. The laminar flow (shown in FIG. 1 as 12A) provided by the present invention results in a substantial reduction in vortexing and spiraling associated with prior art nozzles not having fluted arrangements, and which would otherwise entrain undesired slag, or other foreign inclusions into the mold or tundish and, thereby, cause flaws in the resulting casted product.

It should be appreciated that the antivortexing means of the present invention is in direct contact with the molten metal 14 in ladle 16, and is located at the inlet to the metering assembly, whereas previously known antivortexing devices have been located in the collector nozzle portion of the metering assembly, at the outlet, or in the upper and lower well nozzle inlet.

An alternative metering assembly may employ a modified stopper rod 28 shown in FIG. 11 to also further reduce vortexing from the tundish. A modified stopper rod 28 includes vanes 92 near the tip or base of the stopper rod 28. Modified stopper rod 28 may include two, four, or more vanes spaced equally around circumference of base 28B of stopper rod 28. The preferred configuration provides four vanes 92 around the circumference of base 28B of stopper rod 28.

A further embodiment of this invention would comprise a stopper rod 28 in combination with a vortex suppressor insert 17. Vortex suppressor insert 17 is characterized by having one or more vanes 19 which extend towards opening 36A and interact with the flow of metal before it reaches opening 36A. The interaction of vanes 19 with the flowing molten metal breaks up the swirling action and reduces vortexing.

Figure 13A:
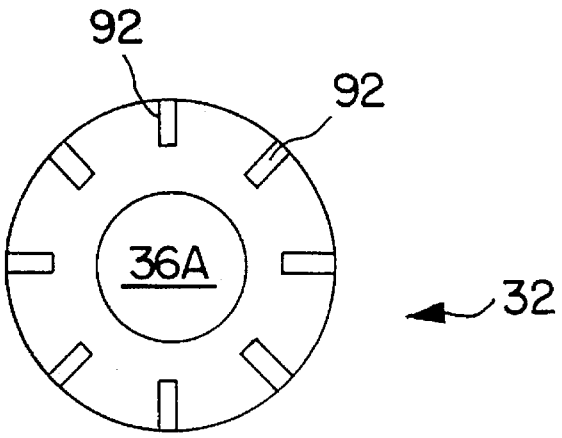
Figure 13B:
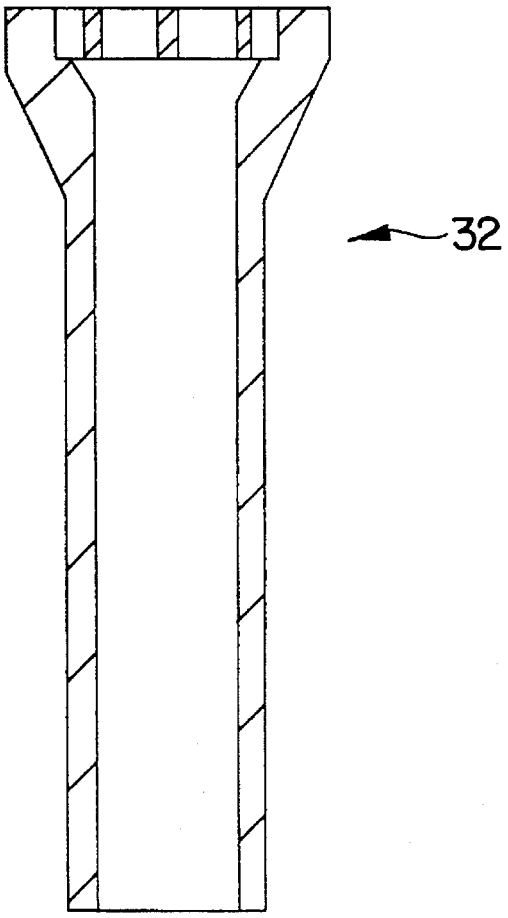

A further embodiment of this invention would comprise a stopper rod 28 in combination with a modified sub entry shroud 32. Modified subentry shroud 32 is illustrated in FIG. 13. Subentry shroud 32 has been modified to provide vanes 92 configured to engage the molten metal. In order for molten metal to flow from the tundish into the molds, stopper rod 28 must be lifted vertically from its seating engagement with subentry shroud 32.

Traditionally, it was believed by experts in the field that a stopper rod 28 without vanes 92 suppressed the effects of the vortexing in a metal pouring vessel. However, it has been discovered that a significant amount of surface matter (air) is still being vortexed into the outlet nozzle employing a traditional stopper rod system. As a result of the addition of vanes 92 to the stopper rod 28 near its tip or base, as shown in FIG. 11, 100% of the remaining vortex in a molten metal pouring box employing a modified stopper rod 28 is suppressed. The addition of vanes 19 to tundish bottom 17 in the form of a new piece around the stopper rod seat and/or to the top of subentry shroud 32 will also suppresses any vortexing.

Although the use of devices in the form of an insert have been described as acting as the antivortexing means of the present invention, it should be recognized that other devices having forms different than the flutes described may be used in the practice of this invention. For example, triangular, rectangular, ripple or other shaped extensions may be used so long as a portion of the flow of the molten metal is intercepted and the antivortexing effect is accomplished. Other embodiments of the present invention provide for laminar output flow of the molten metal to the mold and may be further described with reference to FIGS. 5–10.

Figure 7A:
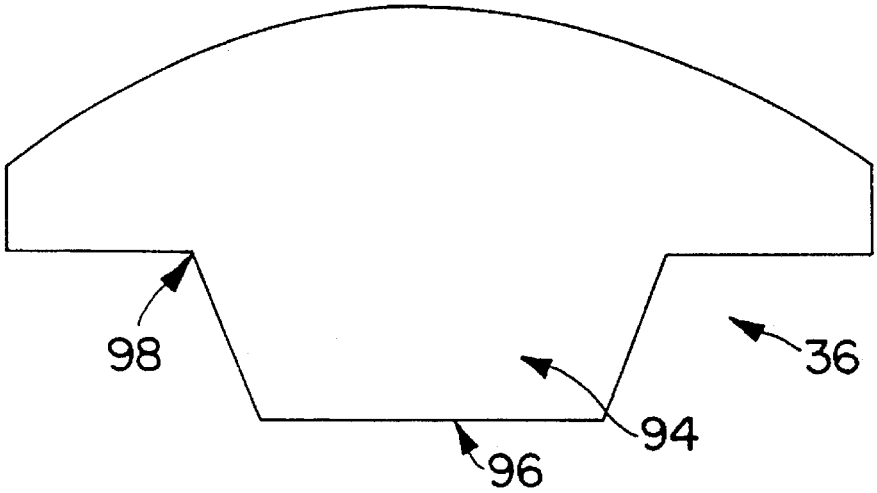
FIGS. 5, 6, 7, 7*a*, 8, 9 and 10 illustrate alternative embodiments of the insert, which reduce vortexing of the outflow of metal o from the metering assembly.
Figure 5:
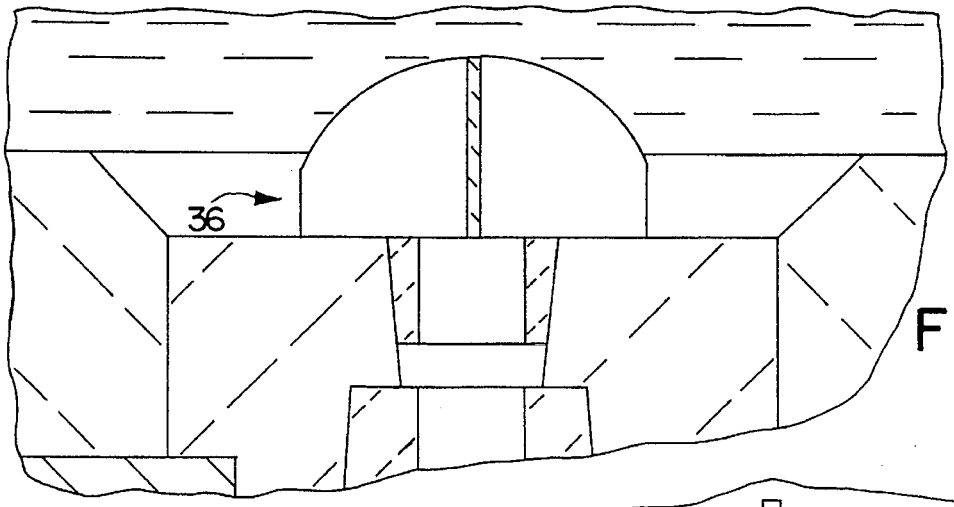
Figure 6:
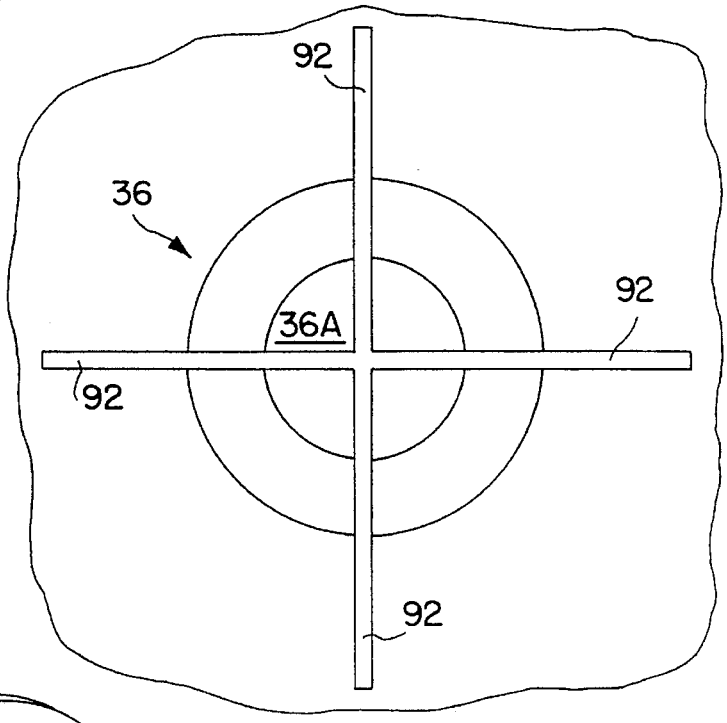
Figure 7:
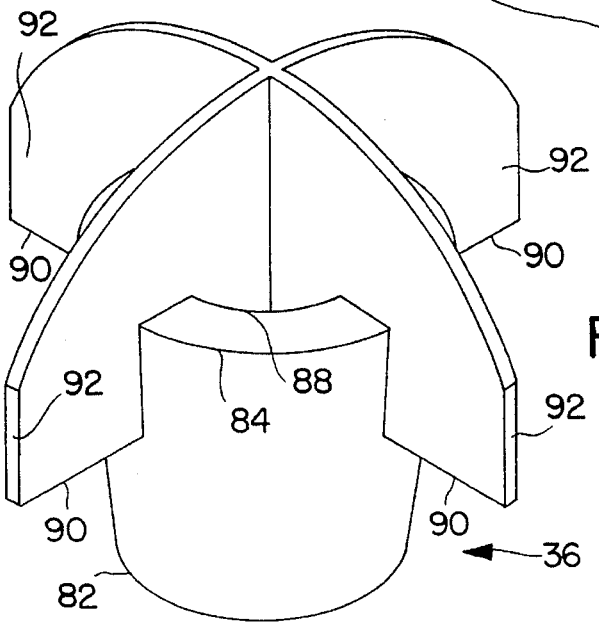

FIGS. 6 and 7 illustrate a modified insert 36 in combination with a housing. Insert 36 comprises a pair of vanes 92 which are disposed at right angles to each other and which have upper portions configured as semi-circles. The semi-circular configuration of the upper portions of vanes 92 provides greater interaction between the vanes 92 and the molten metal than the configuration shown in FIGS. 3 and 4. The modified insert 36 further comprises a outlet 80 (not shown) whose outer wall extends from base 82 to the upper edge 84. The inner wall of the modified insert 36 has a downwardly sloped portion 86 (not visible in FIG. 7 but visible in the analogous structure in FIG. 4) that starts at location 88 near the upper edge 84. FIG. 7*a* illustrates the modified insert 36 without a housing. The modified insert 36 without a housing may preferably be configured with two, four, or more vanes which have upper portions configured as semi-circles.

Figure 8:
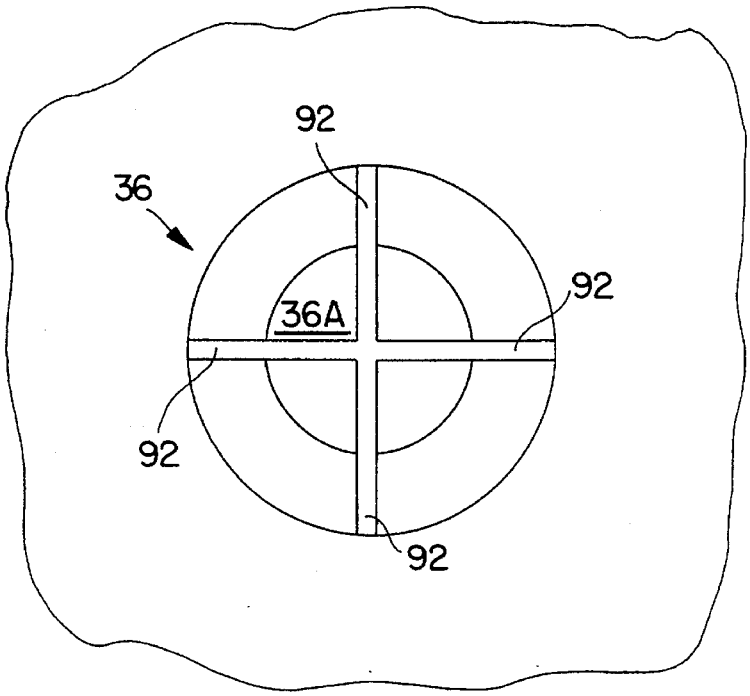
Figure 9:
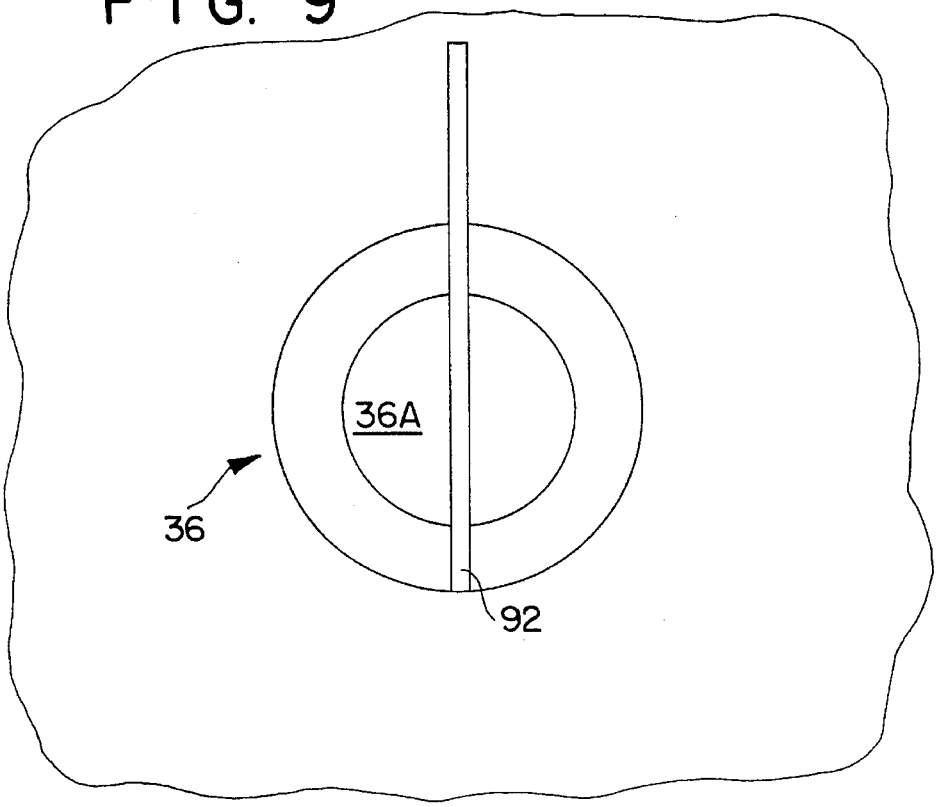

The modified insert 36 further provides a flat surface 90 to permit the modified insert 36 to rest flush with well block 52. With respect to insert 36 shown in FIG. 7*a*, mid-section 98 lies flush with well block 52. While vanes 92 are shown extending beyond the outer edge 84 in FIGS. 6 and 7, the modified insert 36 could be further modified to terminate one or more of the vanes 92 at the outer edge, as shown in FIG. 8, and still obtain an acceptable reduction in vortexing. Likewise, insert 36, shown in FIGS. 3 and 4 may be modified in a similar manner, as shown in FIG. 9.

Figure 10:
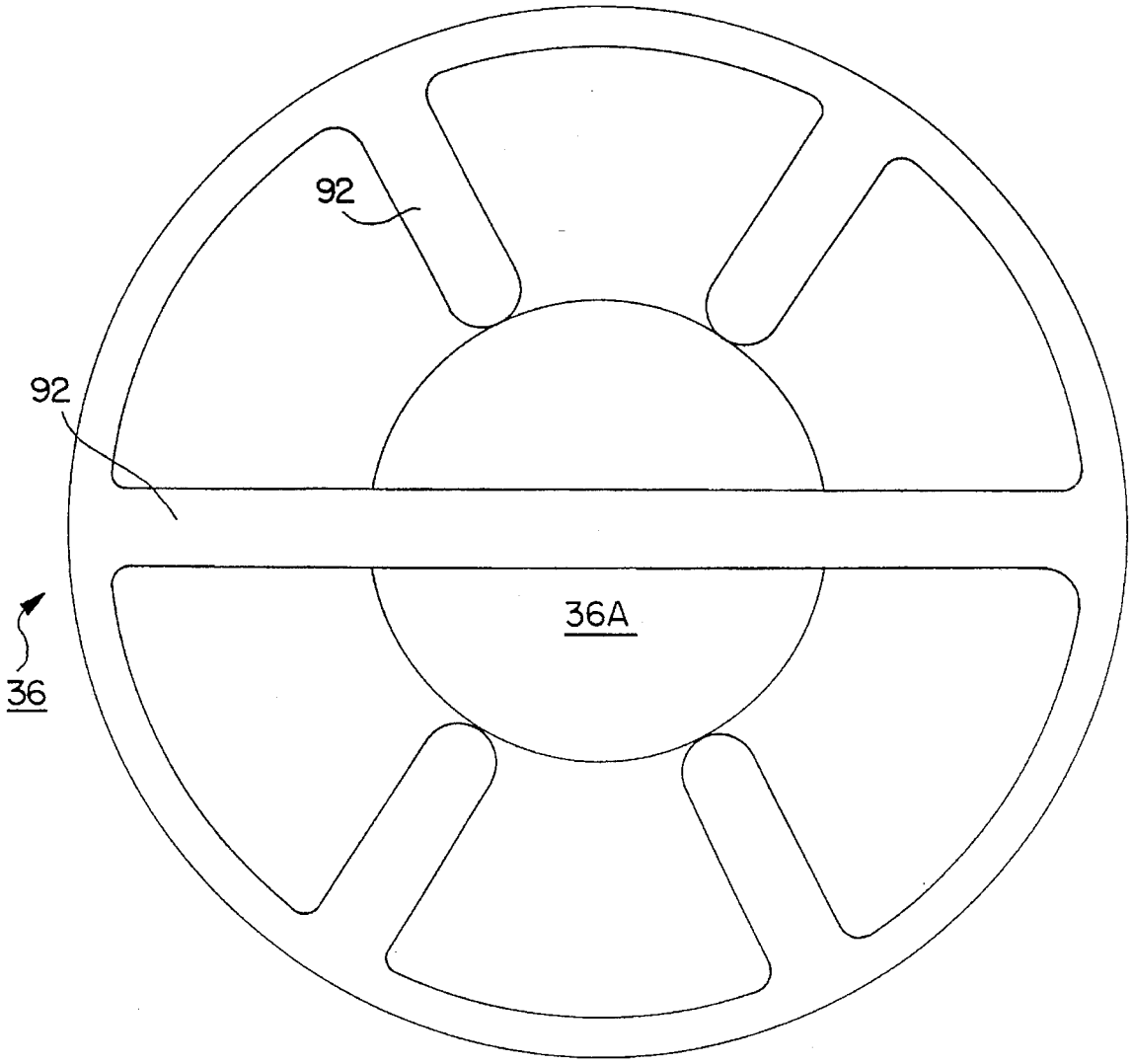

A further embodiment is shown in FIG. 10. The insert 36 shown in FIG. 10 comprises a combination of a nozzle insert including a plurality of vanes 92 extending into central opening 36A, and one vane 92 that extends entirely across the central opening 36A to intercept a portion of the molten metal flowing therethrough. The vanes 92 comprise an upper portion that may be configured as rectangular, triangular, ripple, or semicircular so long as a portion of the flow of molten metal is intercepted and the antivortexing effect is accomplished.

As already mentioned, FIG. 1 illustrates a system 10 similar to prior art molten metal pouring systems. However, unlike prior art molten metal casting systems, system 10 also has a fluted nozzle in the path of the outflow of molten metal from the ladle 16. The placement of the fluted nozzle in the ladle 16 decreases the amount of metal that would otherwise be treated as scrap and, thereby, decreases the attendant cost involved with reprocessing scrap metal.

More particularly, a typical pouring process, applicable to either arrangement having a fluted nozzle in both the ladle 16 and tundish 18 or with the fluted nozzle in only the tundish 18, involves somewhere between 250 to 400 tons of steel. Typically, when pouring 250 to 400 tons of steel in a system having the fluted nozzle in only tundish 18, the slag 20 that is present on the surface of the molten metal 20 of ladle 16 begins to be vortexed into the outflow of molten metal from the ladle 16 to the tundish 18. When this occurs, the outflow of molten metal from the ladle 16 is stopped. Typically, 2 to 4% of the molten metal, or 10,000 to 32,000 pounds, remains in ladle 16. This amount of metal is removed and remelted. The remelting of scrap metal costs about $100.00/ton and, therefore, the cost of returning and heating 10,000 to 32,000 pounds of metal results in a remelting cost of between $500.00 to $1,600.00, respectively. The present invention, by providing the means for reducing the vortexing condition that might otherwise exist in the ladle 16, reduces the amount of scrap metal from the range of between 10,000 to 32,000 pounds to an amount of about 1,000 pounds.

Reducing the scrap metal from 10,000 pounds to 1,000 pounds per heat yields a savings of approximately $450.00 per heat, which corresponds to the unnecessary cost of reheating 9,000 (10,000–1,000) pounds. This value increases to about $1,550.00 per heat when 31,000 (32,000–1,000) pounds of scrap metal are eliminated from being reheated.

It should now be appreciated that the practice of the present invention by providing a fluted nozzle in the ladle of the molten metal pouring equipment yields substantial cost benefits, while still resulting in a cast product that is substantially free of flaws.

Moreover, the present invention provides a solution to a problem that has plagued metal casting operations. This solution is conveniently implemented and its benefits are substantial.

Furthermore, it should be appreciated that the present invention provide a single piece, more particularly an insert, that is easily installed into an existing metering assembly, so as to conveniently retrofit existing ladles to provide a molten metal pouring system having the benefits of the present invention.

Although the previously described molten metal pouring system comprises a fluted nozzle in each of the ladle 16 and the tundish 18, it should be recognized that the system 10 need only have the fluted nozzle arrangement in the ladle 16 to yield the benefits of the present invention. Furthermore, for such arrangements, the tundish 18 need only have a nozzle to control or direct the outflow of molten metal and need not have an on-off control device such as the slide-gate assembly 58 of FIG. 2.

Further, although the metering assembly 12 of FIG. 2 has been described as comprising the insert 36 and the nozzle sections 42, 44, 46 and 48, it should be realized that the nozzle sections 42 and 44 may be integrated into one nozzle section.

The present invention is best suited for continuous casting of metal products such as billets, blooms, slabs and strips. However, the invention is also useful in uphill teeming or top casting of ingots. Moreover, the invention can be used in other metal casting operations.

The present invention may be embodied in other specific forms without departing from the spirit for essential attributes thereof and, accordingly, reference should be made to the appended claims, rather than to the foregoing, specification, as indicating the scope of the invention.

I claim:

1. In combination, an antivortexing device and a metal pouring vessel, said vessel having a horizontal base surface and a refractory lining including an outlet orifice having a central opening therein for the passage of molten metal therethrough, said antivortexing device comprising a housing defining an opening corresponding to the central opening and at least one straight vane above the horizontal base surface of the vessel and extending completely across and beyond the central opening for interacting with molten metal flowing therethrough, said antivortexing device being located at an inlet region of the central opening.

2. In combination, a metal pouring vessel having a horizontal base surface and a refractory lining, a stopper rod assembly and an antivortexing means, the metal pouring vessel having a pouring orifice comprising an inlet portion, an outlet portion, an opening extending between the inlet and the outlet portions defining a passage for the flow of molten metal therethrough, and a stopper rod assembly for selectably controlling flow of molten metal through the opening, the stopper rod having a plurality of vanes extending radially outward from a tip region thereof, the antivortexing means being located in the opening adjacent the inlet portion and comprising a housing defining a second central opening for receiving the tip region of said stopper rod and a plurality of vanes extending above the base surface of said vessel and extending radially toward the second opening, said vanes on said stopper rod and on said antivortexing means interacting with molten metal flowing through said second opening.

* * * * *

UNITED STATES PATENT AND TRADEMARK OFFICE
CERTIFICATE OF CORRECTION

Patent No.: 5,544,695

Dated: August 13, 1996

Inventor(s): Michael Harasym

It is certified that error appears in the above-identified patent and that said Letters Patent is herby corrected as shown below.

On the title page, item

--[73] Assignee: Reuning-McKim, Inc., Saxonburg, PA

Signed and Sealed this

Seventeenth Day of December, 1996

*Attest:*

Bruce Lehman

BRUCE LEHMAN

*Attesting Officer*

*Commissioner of Patents and Trademarks*